United States Patent [19]

Davison

[11] 4,222,708

[45] Sep. 16, 1980

[54] METHOD AND APPARATUS FOR REDUCING ECCENTRICITY IN A TURBOMACHINE

[75] Inventor: Samuel H. Davison, Cincinnati, Ohio

[73] Assignee: General Electric Company, Cincinnati, Ohio

[21] Appl. No.: 919,534

[22] Filed: Jun. 26, 1978

[51] Int. Cl.[2] ..... F01D 25/28

[52] U.S. Cl. ..... 415/127; 403/4; 403/DIG.7; 415/190; 415/219 R

[58] Field of Search ..... 415/126, 127, 189, 190, 415/219 R, 128, 170 R, 170 A, 171; 403/4, DIG. 7

[56] References Cited

U.S. PATENT DOCUMENTS

| | | | |
|---|---|---|---|
| 2,915,280 | 12/1959 | Sonder | 415/138 |
| 3,269,677 | 8/1966 | Stoeckly | 415/126 |
| 3,385,624 | 5/1968 | Baclini | 403/4 |
| 3,860,356 | 1/1975 | Benz | 415/128 |
| 4,127,357 | 11/1978 | Patterson | 415/170 R |

*Primary Examiner*—Everette A. Powell, Jr.
*Assistant Examiner*—A. N. Trausch, III
*Attorney, Agent, or Firm*—Dana F. Bigelow; Derek P. Lawrence

[57] ABSTRACT

An inherent eccentricity between the rotor bearings and the stator shroud is reduced by intentionally fabricating into each of a pair of frame annuluses, outer and inner surfaces which are relatively eccentric, and then rotating the annuluses with respect to each other until the inherent eccentricity is substantially offset. A method is provided to determine the optimum relative rotational positions as a function of the measured inherent eccentricity, and restrictions in the number of possible rotational positions are considered.

15 Claims, 6 Drawing Figures

METHOD AND APPARATUS FOR REDUCING ECCENTRICITY IN A TURBOMACHINE

BACKGROUND OF THE INVENTION

This invention relates generally to gas turbine engines and, more particularly, to a rotor and shroud apparatus and method of assembly.

In the normal practice of assembling stationary shrouds and related hardware around a turbine rotor, there occurs an inherent eccentricity between the running center of the rotating member and the surrounding stationary structural components. The primary reason for this eccentricity is the unavoidable stack-up of the machining tolerances in the combination of the various structural members between the bearings and the turbine shroud. This tolerance stack-up in a typical gas turbine engine can be on the order of 0.005 to 0.015 inch and, considering that this eccentricity must be accommodated by increased clearances, it may represent an approximate one-half to one and one-half points of loss in turbine efficiency.

One method by which the eccentricities may be reduced so as to not require the increased clearances is by way of machining after assembly. In the case of a turbomachine where the high pressure turbine is the primary focus of concentricity, this requires the mounting of the entire low pressure turbine rotor and structural components on a vertical turret lathe and machining the high pressure turbine shrouds as accurately as possible so as to be concentric with the bearing. Not only is this process difficult and time consuming, but it also requires the use of expensive tooling and facilities.

Another disadvantage of the machining process is that concentricity or near-concentricity is achieved only for that particular combination of hardware. If in the normal deterioration of the engine, the structural components tend to wear and distort, eccentricities will tend to re-appear and increase with age, thus requiring another time-consuming and expensive machining process for correction. Further, in the refurbishment of the engine, if certain components are replaced or interchanged, the resulting eccentricity must again be accounted for in this undesirable manner.

It is therefore an object of the present invention to provide a rotor and shroud combination which is substantially in concentric relationship.

Another object of the present invention is the provision in a turbomachine for the reduction in eccentricity between the rotor bearings and the stationary shroud surrounding the rotor.

Yet another object of the present invention is the provision in a turbomachine for the elimination of expensive machining processes in order to obtain relative concentricity between the rotor bearing and the rotor shroud.

Still another object of the present invention is the provision in a turbofan engine for increased efficiency.

Another object of the present invention is the provision for the economic assembly of rotating turbine and stationary shroud components.

A further object of the present invention is the provision of an economical and effective method and apparatus for obtaining substantial concentricity between a rotor and a surrounding stationary shroud.

These objects and other features and advantages become more readily apparent upon reference to the following description when taken in conjunction with the appended drawings.

SUMMARY OF THE INVENTION

Briefly, in accordance with one aspect of the invention, a pair of annular mating elements are selected from those in the stationary structure between the rotor bearing and the stationary shroud. Each of these two elements is then intentionally machined such that its outer and inner sides are eccentric by a predetermined amount. The two elements are then assembled with the rest of the stationary elements and are then rotated to selected positions so as to reduce the eccentricity between the rotor bearing and the shroud. By properly selecting the degree of machined eccentricity and the positions to which the two elements are rotated, the inherent eccentricity resulting from stack-up of machining tolerances can be substantially offset.

By another aspect of the invention, the eccentricities fabricated in each of the two elements are equal, and in the initial assembly of the engine the relative positions are such that one eccentricity offsets the other. A runout measurement is then taken to determine the degree and direction of the inherent eccentricity between the rotor bearing and the stationary shroud. This information can then be used to determine the most desirable rotational positions for the two elements for offsetting the measured eccentricity.

By yet another aspect of the invention, the solution may be linearized by the use of a nomograph which vectorially represents the possible positions of eccentricity and the associated circumferential placement requirements of the two elements for offsetting those eccentricities. One can then readily take the measured eccentricity and enter the graph to determine the best possible positions for the rotation of the two elements in order to obtain substantial concentricity.

In the drawings as hereinafter described, a preferred embodiment is depicted; however, various other modificiations and alternate constructions can be made thereto without departing from the true spirit and scope of the invention.

DESCRIPTION OF THE PREFERRED EMBODIMENT

Figure 1:
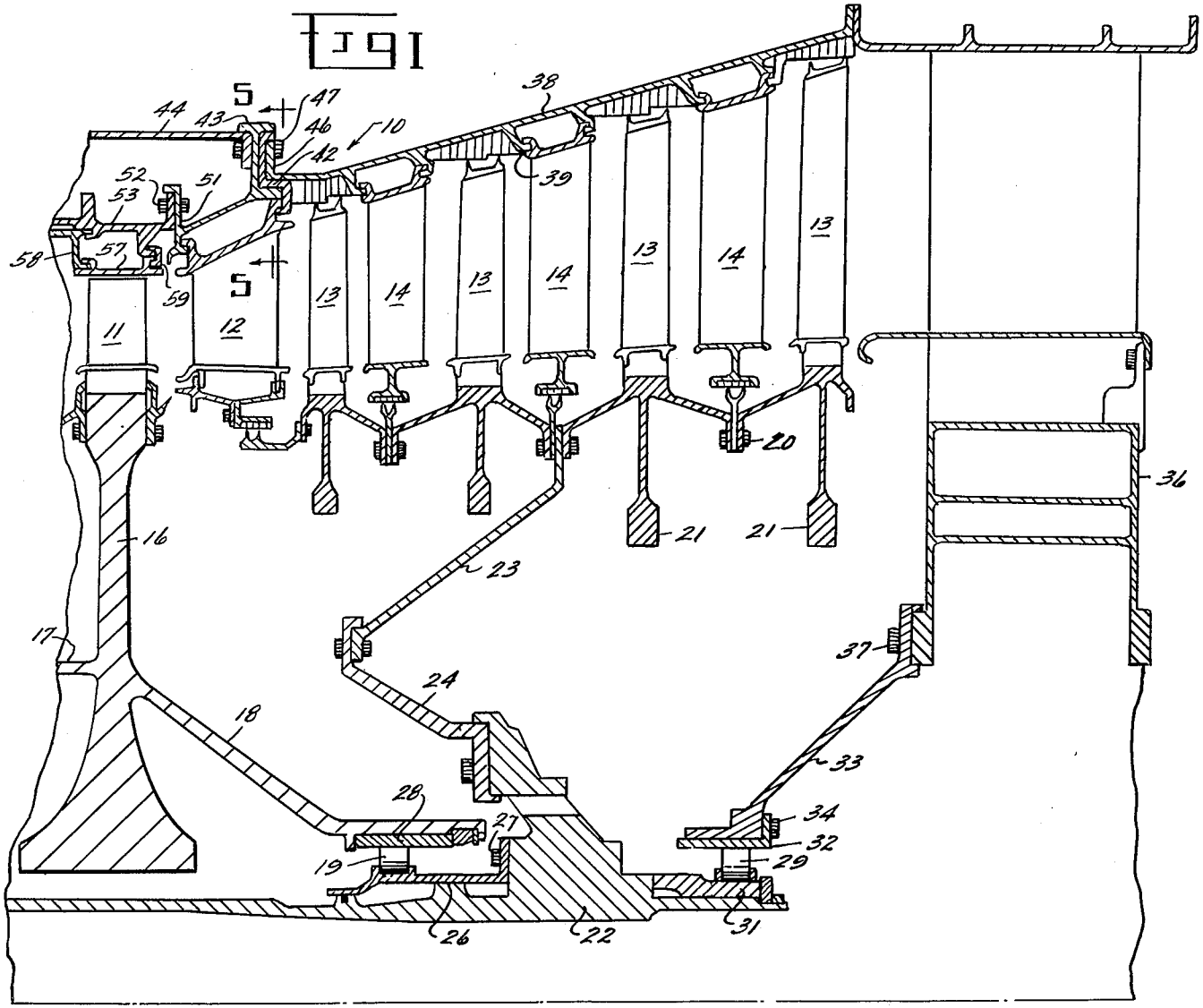
FIG. 1 is a longitudinal cross-sectional view of a turbine structure in accordance with the preferred embodiment of the invention.

The invention is shown generally at 10 in FIG. 1 as being incorporated into a somewhat conventional turbine structure. The structure includes a single row of circumferentially spaced high pressure turbine blades 11, a circumferential row of low pressure turbine vanes 12 and a plurality of alternating low pressure blade and vane rows 13 and 14, respectively, which receive hot gases from the combustor to drive the high and low pressure spools in a manner well known in the art. In the case of the high pressure turbine, the blades 11 are mounted in circumferentially spaced relationship in the periphery of a high pressure turbine disk 16 having a forward extending high pressure turbine shaft 17 which drivingly connects to the compressor (not shown). A high pressure turbine stub shaft 18 extends rearwardly from the high pressure turbine disk 16 to a bearing 19 which provides support for the high pressure turbine shaft 17.

The low pressure turbine blades 13 are mounted in the periphery of low pressure turbine disks 21 which are interconnected by fasteners 20 to collectively form a drum which is drivingly connected to the low pressure shaft 22 by way of outer and inner low pressure turbine cone shafts 23 and 24, respectively.

The bearing 19 is interposed between the radially outer high pressure turbine stub shaft 18 and the radially inner low pressure shaft 22. An inner race 26 is attached to the low pressure shaft 22 by way of a plurality of fasteners 27, and an outer race 28 is attached to the high pressure turbine stub shaft 18 in a similar manner. In this way, the low pressure shaft 22 provides support for the high pressure turbine disk 16.

Support for the low pressure shaft 22 is provided by a bearing 29 having an inner race 31 attached to the periphery of the low pressure shaft 22 and an outer race 32 attached to a stationary bearing cone 33 by a plurality of fasteners 34. The bearing cone 33 is, in turn, rigidly attached to a stationary low pressure turbine frame 36 by way of a plurality of fasteners 37.

Considering now the outer flow path of the turbine gases, a low pressure turbine casing 38 is rigidly attached to and extends forward of the low pressure turbine frame 36. On the radially inner side of the low pressure turbine casing 38 is a plurality of support flanges 39 for retaining the outer ends of the low pressure turbine vanes 14. Mounted intermediate adjacent pairs of support flanges 39 are honeycomb shrouds 41 which closely surround the low pressure turbine blades 13 in a manner well known in the art.

Figure 2:
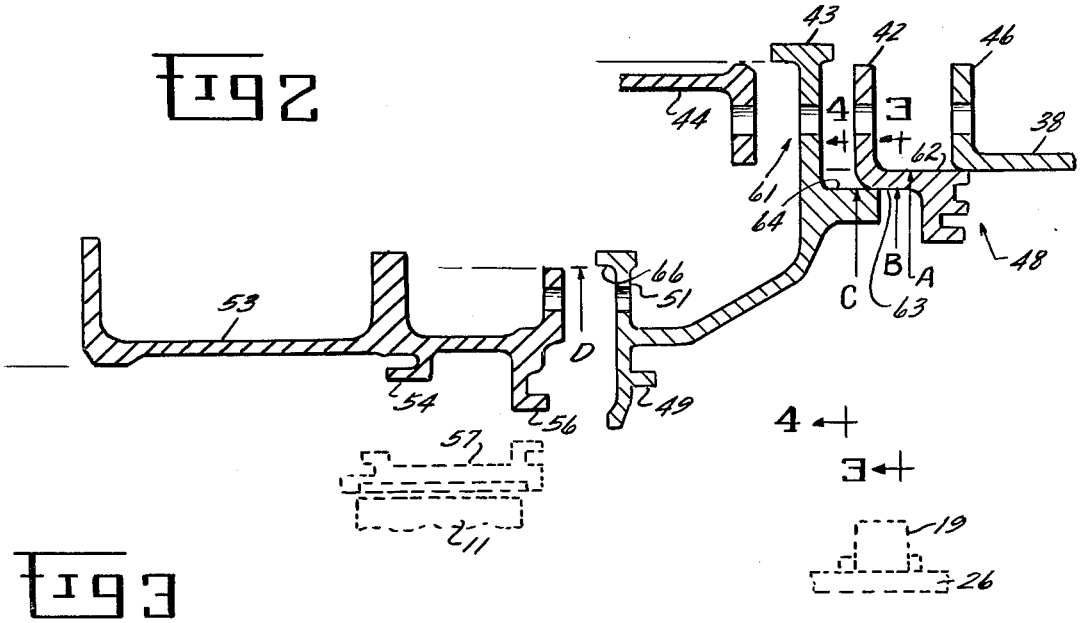
FIG. 2 is an exploded partial view of specific components thereof.

At the forward end of the low pressure turbine casing 38 there is mounted in combination a low pressure shroud support 42, a low pressure nozzle support 43 and a combustor casing 44. These three annular elements are secured to an outer flange 46 of the low pressure turbine casing 38 by a plurality of circumferentially spaced fasteners 47. Referring to FIGS. 1 and 2, it will be seen that the low pressure shroud support 42 includes an annular groove 48 for receiving and retaining the low pressure turbine shroud. Similarly, the low pressure nozzle support 43 has a lip 49 for receiving in support relationship a flange of the low pressure nozzle 12. Secured to a radially outer extending flange 51 of the low pressure nozzle support 43 by a plurality of fasteners 52 is the one end of a high pressure shroud support 53. It will be seen that the high pressure shroud support 53 has a pair of annular flanges 54 and 56 which act to positively support and position the high pressure turbine shroud 57 by way of hanger brackets 58 and 59, respectively.

It is, of course, highly desirable to have the shroud 57 so positioned as to be concentric with the high pressure turbine blades 11 with a minimum amount of clearance during various periods of operation. The clearance between the rotating blades and the stationary shroud can be modulated to accommodate different static and transient operating conditions by various schemes of controlling the thermal growth of the high pressure shroud support 53. The roundness of the assembled high pressure turbine shroud 57 can be facilitated by simply machining the shroud to a round configuration.

However, a problem arises when, even though the high pressure turbine shroud 57 is round, it is not concentric with the row of high pressure turbine blades 11. To accommodate this eccentricity by a grinding of the high pressure turbine shroud 57 to be concentric with the row of high pressure turbine blades 11 is a more complicated and expensive operation than the aforementioned machining operation. Further, even if this more complicated operation is performed, a later replacement of one of the stationary elements described hereinabove may very well change the position of the high pressure turbine shroud 57 to render it again eccentric with respect to the turbine blades.

Even considering the assembly of new engine components, wherein the various components are designed and fabricated to dimensions and tolerances which, when in the assembled condition should result in a concentric combination, there will most likely be an inherent eccentricity between the stationary and rotating components. That is, assuming that the row of turbine blades 11 is concentric with its bearing 19, there tends to be a stack-up of tolerances in the stationary components between the bearing 19 and the stationary shroud 57. The present invention recognizes this inherent eccentricity and provides a method and apparatus for reducing or substantially correcting it.

Referring to FIGS. 2–5, it will be seen that the low pressure shroud support 42 and the low pressure nozzle support 43 are annular in form and can be rotated to various possible circumferential positions, subject to the requirement for their being fastened into their final position. For purposes of this description, it will be assumed that the number of bolt holes 61 passing through both the low pressure shroud support 42 and the low pressure nozzle support 43 is equal to twelve. Further, it will be assumed that the low pressure nozzle support 43, because of its requirement for facilitating the insertion of a boroscope, can be placed in any of four possible circumferential positions. Thus, the low pressure shroud support 42 can be rotated to twelve different positions with respect to the low pressure nozzle support 43, and the low pressure nozzle support 43 can be rotated to four possible positions with respect to the high pressure shroud support 53. There is then provided a total of forty-eight possible circumferential placement positions of the combination.

Figure 3:
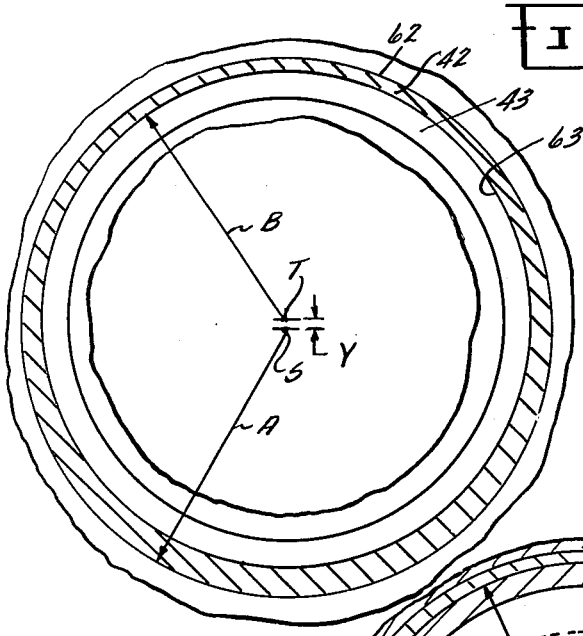
FIG. 3 is a fragmented sectional view thereof as seen along line 3—3 of FIG. 2.

In order to enable the offsetting of the inherent eccentricity of the assembled machine, both the low pressure shroud support 42 and the low pressure nozzle support 43 each have relatively eccentric outer and inner surfaces intentionally fabricated therein. Referring to FIGS. 2 and 3, the low pressure shroud support 42 has a radially outer annular surface 62 which fits into the low pressure turbine casing 38 in tight-fit relationship and has a radius of A from a centerpoint S. The inner surface 63 has a radius B with a center T that is offset upwardly at a distance Y from the centerpoint S. This results in an eccentric or lopsided cross section of the low pressure shroud support as seen in FIG. 3 in exaggerated form.

Figure 4:
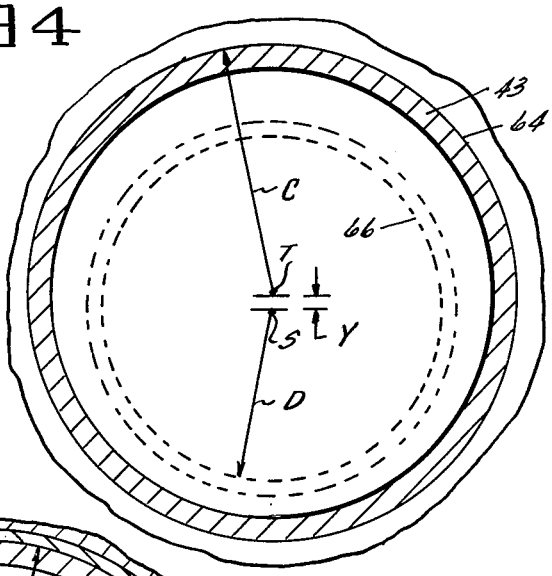
FIG. 4 is a fragmented sectional view thereof as seen along line 4—4 of FIG. 2.

Referring now to FIGS. 2 and 4, the low pressure nozzle support 43 is shown with an outer surface 64 which fits telescopically in close-fit relationship with the inner surface 63 of the low pressure shroud support 42 and has a radius of C from the centerpoint T. At the other end of the low pressure nozzle support 43 there is an inner surface 66 which has a radius of D from the center S which is offset by the distance Y from the center T in the downward direction. Again, the concentricity of the outer and inner annular surfaces, 64 and 66, respectively, are shown in exaggerated form.

Figure 5:
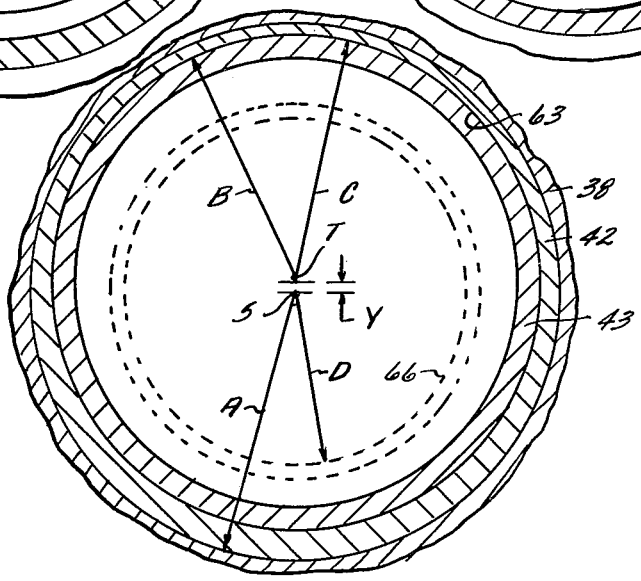
FIG. 5 is a cross-sectional view as seen along line 5—5 of FIG. 1.
Figure 6:
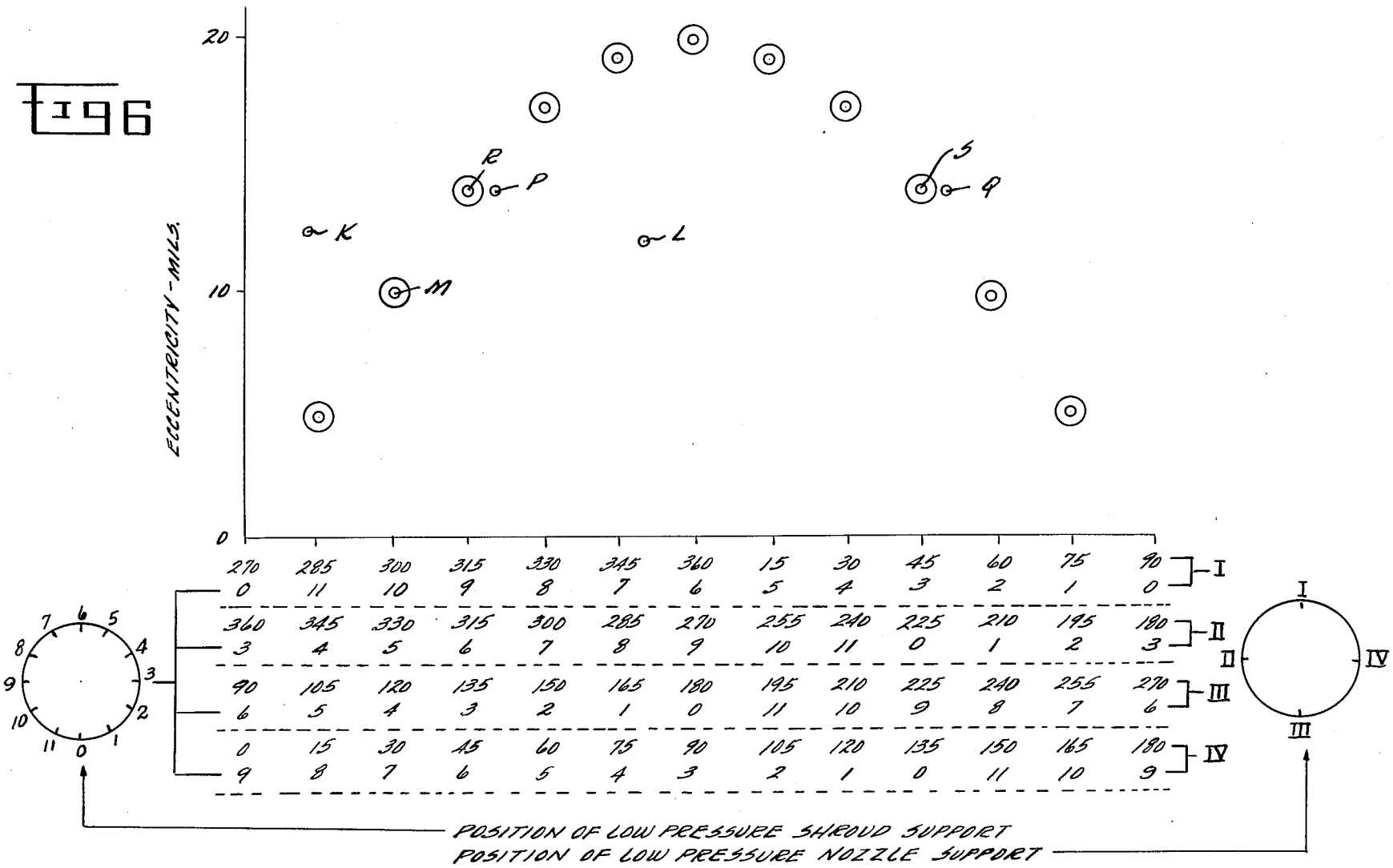
FIG. 6 is a graphic illustration of possible circumferential positions of various components for given eccentricities.

Referring now to FIG. 5 wherein the low pressure shroud support 42 and the low pressure nozzle support 43 are shown in the assembled position, it can be seen that the upward shift of the inner surface 63 of the low pressure shroud support is offset by the downward shift of the inner surface 66 of the low pressure nozzle support 43 by an equal distance Y. When assembled in that position then, there is no resultant change in the center of the shroud with respect to the low pressure turbine casing, for example. If there is found to be substantially no inherent eccentricity in the stationary structure as discussed hereinabove then the two elements, the low pressure shroud support 42 and the low pressure nozzle support 43, can be assembled in these relative positions and the high pressure shroud 57 will remain concentric with the high pressure turbine rotor. However, if there is found to be an inherent eccentricity as a result of tolerance stack-up or for what other reason, then the two stationary elements, the low pressure shroud support 42 and the low pressure nozzle support 43 can be relatively rotated to one of the possible forty-eight positions as discussed hereinabove to compensate or correct this eccentricity. In order to facilitate the choosing of the most appropriate circumferential position among the forty-eight possible positions, a nomograph has been prepared to illustrate the effect that these various positions will have on the shifting of the center of the combination. Such a nomograph is shown in FIG. 6 wherein the distance Y of vertical offset is assumed to be 0.010 inch and therefore the total offset can be as much as 0.020 inch. The amount or distance of eccentricity is shown in the ordinate and the direction or angle of the eccentricity is shown in the abscissa. It will be seen that there are only twelve positions shown in the graph; however, there are four different abscissa scales, one for each of the four possible positions of the low pressure nozzle support. So, for each of the four low pressure nozzle support positions there are shown twelve possible positions of the low pressure shroud support. The nomograph is used to determine which of the possible forty-eight positions will best offset the actual inherent eccentricity of the assembled apparatus.

The process of correcting an inherent eccentricity in an assembled turbomachine can be briefly described as follows. The module is first assembled with the low pressure shroud support 42 and the low pressure nozzle support 43 placed in the offsetting circumferential position as shown in FIGS. 3, 4 and 5. The shroud is then measured by way of a runout measurement or the like to determine the magnitude and angular position of its eccentricity from the bearing 19. The values are then used to enter the nomograph to determine the possible rotational position which would bring about a lessening of the eccentricity. The one position which brings about the greatest correction is then chosen and the low pressure shroud support 42 and the low pressure nozzle support are then moved to the rotational positions indicated.

A couple of examples will better illustrate the use of the nomograph. Assume that when the low pressure module is in the assembled condition the runout measurement indicates an inherent eccentricity of 0.012 inch in a direction of 100°. Since we must move the module in the opposite direction to correct the eccentricity, we enter the graph with the values of 0.012 inch and 280°. Referring to the four abscissa scales, there are two possible positions (I and II) to which the low pressure shroud support may be moved in order to move the assembly toward the positions K and L wherein the eccentricity would be completely offset. The next step is to determine which of the possible forty-eight positions is the best or closest to those two points. It will be readily seen that the point M is the closest to either point K or L and, since the closest direction to 280° is 300°, the best possible choice is to place the low pressure nozzle support in position I and the low pressure shroud support in position 10.

It will be recognized that since the point of actual eccentricity did not fall exactly on one of the possible forty-eight points, the actual eccentricity will not be completely offset by a movement of the two elements to this new position. However, it will be substantially improved and, may be almost entirely corrected.

To take another example, let us assume that the eccentricity is measured to be 0.014 inch in a direction of 230°. The two possible positions for complete correction are then illustrated by the points P and Q (low pressure shroud support position I or IV). Since the closest respective possibilities are points R and S, the eccentricity can be substantially corrected by moving the stationary parts to either of the two combinations, with the low pressure nozzle support in position I and the low pressure shroud support in position 3, or the low pressure nozzle support in the position IV and the low pressure shroud support in position 6.

It will be recognized that the use of a nomograph is only one of many ways to determine the best choice for the element positions. For example, a simple computer program can be developed for this purpose, or a tabular listing may be generated for use in making the selection.

From the foregoing description, it can be seen that the present invention comprises a method of correcting inherent eccentricities in a turbomachine and includes particular component designs to facilitate this process. While it has been described in terms of a preferred embodiment, it will be obvious to one skilled in the art that various modifications and changes can be made without departing from the scope of the invention. For example, it will be appreciated that, although the invention was particularly described with the use of the low pressure shroud support and the low pressure nozzle support as the rotatable elements, other stationary elements such as the high pressure shroud support or the low pressure casing could just as well be used.

Therefore, having described a preferred embodiment of the invention, what is desired to be secured by Letters Patent of the United States is as follows:

I claim:

1. An improved turbomachine structure of the type having a bearing supported rotor and a surrounding frame supported shroud which is susceptible to eccentricity with respect to the bearing wherein the improvement comprises:

(a) a first frame element having outer and inner annular surfaces with centers that are relatively radially offset by a first predetermined distance;

(b) a second frame element having outer and inner annular surfaces with centers that are relatively radially offset by a second predetermined distance; and (c) means for relatively rotating said first and second frame elements to selected positions so as to substantially reduce any existing eccentricity between the shroud and the bearing.

2. An improved turbomachine structure as set forth in claim 1 wherein said first and second predetermined distances are substantially equal.

3. An improved turbomachine structure as set forth in claim 1 wherein said first and second frame elements are telescopically interconnected.

4. An improved turbomachine structure as set forth in claim 3 wherein said first frame element inner annular surface has substantially the same center as said second frame element outer annular surface.

5. An improved turbomachine structure as set forth in claim 3 wherein said first frame element outer annular surface and said second frame element inner surface have centers which are offset in the same direction from the center of said first frame element inner annular surface.

6. An improved turbomachine structure as set forth in claim 5 wherein said first and second predetermined distances are substantially equal.

7. An improved turbomachine structure as set forth in claim 1 wherein said first frame element comprises a low pressure shroud support element.

8. An improved turbomachine structure as set forth in claim 1 wherein said second frame element comprises a low pressure nozzle support element.

9. In a turbomachine structure of the type having a bearing supported rotor and a surrounding frame supported shroud which is susceptible to eccentricity with respect to the bearing, a method of reducing such eccentricity comprising the steps of:

(a) fabricating a first frame element with outer and inner annular surfaces whose centers are relatively radially offset by a first predetermined distance;

(b) fabricating a second frame element with outer and inner surfaces whose centers are relatively radially offset by a second predetermined distance;

(c) assembling said first and second frame elements in a stationary structure which interconnects the bearing and shroud; and (d) rotating said first and second frame elements to selected circumferential positions so as to substantially reduce any existing eccentricity between the shroud and the bearing.

10. A method as set forth in claim 9 wherein said first and second predetermined distances are substantially equal.

11. A method as set forth in claim 9 wherein said first and second frame elements are assembled in adjoining relationship.

12. A method as set forth in claim 9 and including the step, after assembly, of measuring the eccentricity of the shroud with respect to the bearing.

13. A method as set forth in claim 9 wherein said first and second frame elements are assembled such that the radial offset of said first frame element is in the opposite direction from the radial offset of said second frame element.

14. A method as set forth in claim 12 and including the step of determining the circumferential positions of said first and second frame elements that would offset the measured eccentricity.

15. A method as set forth in claim 14 and including the step of circumferentially rotating said first and second frame elements to the nearest possible positions to those determined to be offsetting.

* * * * *